US007279074B2

(12) United States Patent
Best et al.

(10) Patent No.: US 7,279,074 B2
(45) Date of Patent: Oct. 9, 2007

(54) PAPER MACHINE CLOTHING

(75) Inventors: Walter Best, Duren (DE); Walter Schaaf, Hurtgenwald (DE); Frank Zils, Merzenich (DE)

(73) Assignee: Heimbach GmbH & Co. (DE)

( * ) Notice: Subject to any disclaimer, the term of this patent is extended or adjusted under 35 U.S.C. 154(b) by 399 days.

(21) Appl. No.: 10/917,524

(22) Filed: Aug. 13, 2004

(65) Prior Publication Data

US 2005/0233661 A1 Oct. 20, 2005

(30) Foreign Application Priority Data

Aug. 13, 2003 (EP) ..... 03018342

(51) Int. Cl.
*D21F 1/10* (2006.01)
*D21F 7/12* (2006.01)
*B32B 5/02* (2006.01)

(52) U.S. Cl. ..... 162/348; 162/902; 162/903; 428/142; 428/175; 428/196; 34/95; 442/60; 442/93

(58) Field of Classification Search ..... 162/199, 162/116, 117, 274, 306, 348, 900–904, 358.2, 162/358.4; 34/95; 28/142, 169; 8/115.6; 427/209–211, 176, 288, 394; 442/60, 93, 442/118; 428/57, 58, 141, 142, 163, 167, 428/175, 179, 196
See application file for complete search history.

(56) References Cited

U.S. PATENT DOCUMENTS 3,573,089 A * 3/1971 Tate ..... 442/19
4,376,013 A * 3/1983 Wang ..... 162/274
4,541,895 A 9/1985 Albert
4,621,663 A 11/1986 Malmendier
4,731,281 A * 3/1988 Fleischer et al. ..... 428/196
4,796,749 A 1/1989 Lefferts
4,943,476 A * 7/1990 Sokaris ..... 442/187
5,073,235 A * 12/1991 Trokhan ..... 162/199
5,534,333 A 7/1996 Keller et al.
5,888,915 A * 3/1999 Denton et al. ..... 442/200
6,171,446 B1 * 1/2001 Diaz-Kotti ..... 162/358.2
6,455,447 B1 * 9/2002 Ross et al. ..... 442/94
6,660,362 B1 * 12/2003 Lindsay et al. ..... 428/131

(Continued)

FOREIGN PATENT DOCUMENTS

DE 24 19 751 1/1982

(Continued)

*Primary Examiner*—Eric Hug
(74) *Attorney, Agent, or Firm*—Berenato, White & Stavish

(57) ABSTRACT

The invention refers to a paper machine clothing, in particular a forming wire or dryer felt, having a paper side and a machine side, the paper side being constituted by plastic elements (1, 11, 21, 31), for example in the form of a belt layer, yarns, coils or planar element rods, or the like, the plastic elements being equipped, at least on the surfaces constituting the paper side, with an anti-adhesive coating (5, 6, 14, 15, 24, 25, 34, 35) whose adhesion is less than the adhesion of the material of which the plastic elements (1, 11, 21, 31) are substantially made, which is characterized in that the plastic elements (1, 11, 21, 31) have, at least on the paper side, depressions (3, 4, 12, 13, 22, 23, 32, 33) into which anti-adhesive coating (5, 6, 14, 15, 24, 25, 34, 35) is incorporated.

16 Claims, 1 Drawing Sheet

U.S. PATENT DOCUMENTS

| | | | | |
|---|---|---|---|---|
| 6,773,786 | B1 * | 8/2004 | Kuckart | 428/141 |
| 6,790,796 | B2 * | 9/2004 | Smith et al. | 442/189 |
| 6,918,998 | B2 * | 7/2005 | Hansen | 162/358.2 |

FOREIGN PATENT DOCUMENTS

| | | | |
|---|---|---|---|
| DE | 37 35 709 | | 8/1995 |
| EP | 0 094 638 | | 5/1983 |
| EP | 0 817 886 | B1 | 1/2000 |
| EP | 1 035 251 | A1 | 9/2000 |
| GB | 1058616 | * | 2/1967 |
| WO | WO 92/17643 | | 10/1992 |

* cited by examiner

PAPER MACHINE CLOTHING

CROSS-REFERENCE TO RELATED APPLICATIONS AND CLAIM TO PRIORITY

This application claims priority under 35 U.S.C. § 119 to application number 03 018 342.0, filed Aug. 13, 2003, with the European Patent Office, the disclosure of which is incorporated herein by reference.

FIELD OF THE INVENTION

The invention concerns a paper machine clothing, in particular a forming wire or dryer felt, having a paper side and a machine side, the paper side being constituted by plastic elements, preferably in the form of a belt layer, yarns, coils or planar element rods, or the like, the plastic elements being equipped on the paper side with an anti-adhesive coating whose adhesion is less than the adhesion of the material of which the plastic elements are substantially made.

BACKGROUND OF THE INVENTION

Paper machine clothings are long, wide belts that serve to shape and transport the paper web in a paper machine. They are endless, and circulate in the paper machine over rollers. The outer flat side constitutes the paper side, since the paper web is transported on it. The inner flat side is referred to as the machine side, since it runs over the rollers of the paper machine.

A paper machine has substantially three parts, also called sections. In the first section—the sheet-forming section—forming wires are used as the paper machine clothing. These are generally made of fabrics that are produced from monofilaments. The purpose of the forming wires is to form the paper web and to dewater the paper web through the forming wire. In the next section—the press section—the paper web is subjected to high pressure for purposes of additional dewatering. The press section uses, in particular, press felts that comprise a woven or knitted support and a nonwoven fabric needle-felted thereonto (cf. U.S. Pat. No. 4,943,476). In the subsequent dryer section, the paper web is thermally dewatered, being guided over heated rollers by means of dryer felts. Dryer felts exist in numerous embodiments, principally as woven fabrics (cf. U.S. Pat. No. 4,621,663) although knitted fabrics have also been proposed, or as so-called wire element belts (cf. DE 24 19 751 C3, U.S. Pat. No. 4,796,749, U.S. Pat. No. 5,534,333). These wire element belts are made up of coils, extending transversely to the machine direction, that are coupled to one another via coupling wires. In addition, there are also proposals to assemble a paper machine clothing from a plurality of planar element rods, extending transversely to the machine direction, that are connected to one another via coupling wires (cf. DE 37 35 709 C2; EP 1 035 251 A1). Also known are paper machine clothings which are made of plastic layers that are porous or provided with openings (cf. EP 0 817 886 B1; U.S. Pat. No. 4,541,895; WO 92/17643).

In addition to the aforesaid paper machine clothings, there also exist auxiliary belts, such as transfer belts for transferring the paper web from one section to another, and shoe press belts. These, like the aforesaid paper machine clothings, are adapted to the respective purpose in terms of their surface conformation and structure.

Leaving aside felted materials as paper machine clothings, the surfaces of such paper machine clothings are constituted by plastic elements. In the case of woven and knitted fabrics, these are yarns, in particular monofilaments. In the case of wire element belts (cf. U.S. Pat. No. 4,796,749) the surfaces are constituted by the coils. The same applies to paper machine clothings made up of planar element rods or extruded segments (cf. DE 37 35 709 C2; EP 1 036 251 A1). Paper machine clothings that have a plastic layer or are made up of such a layer on at least one side (usually the paper side) have very smooth surfaces (cf. EP 0 817 886 B1).

The problem exists in this context that contaminants in the form of small particles settle on the paper sides of the paper machine clothings, and build up to form larger dirt deposits. They derive from the raw material of paper production. The source of the particles is, in particular, waste paper. At certain times of year, however, cellulose also contributes sticky contaminants. The range of contaminants extends from tree resins, oils, and adhesives to printing inks, etc. The contaminants interfere with production of the paper web and necessitate cleaning or even premature replacement of the paper machine clothing in the paper machine.

Complex and expensive efforts have been made to remove these contaminants from the paper raw material, or mask them, before production of the paper web. Deposits of dirt on the paper machine clothing nevertheless continue to occur. Attempts have therefore been made to equip the plastic elements constituting the flat side of the paper machine clothings with an anti-adhesive coating, made for example of fluorocarbons or silicone compounds. The dirt particles adhere much less effectively to such coatings than to the material from which the plastic elements are produced. The effect of anti-adhesive coatings is only brief, however, since they are rubbed off the surface of the paper machine clothing by abrasion.

U.S. Pat. No. 4,541,895 discloses a paper machine clothing that is constructed from a plurality of layers provided with openings. It is proposed in this context to shape depressions into the paper-side layer and to incorporate detergents into these depressions. During operation of the paper machine clothing, the detergent is slowly delivered out of the depressions to a washing bath, and is intended thereby to achieve a self-cleaning effect. Contaminants of the kind described above cannot, however, be removed with such detergents. They are moreover effective only in an aqueous environment, and then tend to foam. The washing effect ends as soon as the detergent is consumed by continuous delivery.

WO 01/21884 A1 proposes to impart to those plastic elements that constitute the surface facing the paper web (paper side) a roughness having a depth of between 5 μm and 100 μm, and thereby to prevent the deposition of contaminants. This is based on the idea of not offering to the dirt particles any large continuous contact regions that might serve as adhesion surfaces. This is intended to achieve considerably improved detachment of the dirt particle agglomerations, and to prevent the growth of such agglomerations to sizes that cause quality losses in the paper web. The effect of this action is not satisfactory, however, in particular with deposits in the form of dust and powder.

SUMMARY OF THE INVENTION

It is the object of the invention to embody a paper machine clothing in such a way that the deposition of dirt particles is prevented in substantially more effective and also more long-lasting fashion than in the case of known paper machine clothings.

This object is achieved according to the present invention in that the plastic elements have, at least on the paper side, depressions into which anti-adhesive coating is incorporated. The invention therefore returns to paper machine clothings equipped with anti-adhesive coating. In contrast to the known manner of application, however, the anti-adhesive coating is incorporated into depressions that are shaped into the plastic elements, preferably flush with the surfaces of the plastic elements constituting the paper side. Regions having an anti-adhesive effect, which prevent the attachment of dirt particles, are thereby created on the paper side. This effect is also long-lasting, since the anti-adhesive coating is located in protected fashion in the depressions and is removed in accordance with the abrasion of the plastic elements themselves. The depth of the depressions can be adjusted in such a way that sufficient anti-adhesive coating is available until the end of the paper machine clothing's service life.

It is not troublesome in this context if the surface regions of the plastic elements located between the depressions are also provided with anti-adhesive coating during the manufacturing process. This portion of the anti-adhesive coating will not achieve a long service life as a result of abrasion, but the anti-adhesive coating sitting in the depressions, and its long-lasting adhesive effect, remains unaffected thereby and dependably prevents the attachment of dirt particles.

The anti-adhesive effect can be adjusted, by way of the conformation, size, and distribution of the depressions, in such a way that on the one hand the strength of the plastic elements and their abrasion resistance are diminished insignificantly or only within a permissible context, and other the other hand the anti-adhesive effect is as optimum as possible, so that cleaning of the paper machine clothing is not required or is necessary only at infrequent intervals.

In an embodiment of the invention, provision is made for the depressions to have a V-shaped or U-shaped cross section. Other cross-sectional shapes are, however, also conceivable. They can be embodied as individual blind holes. It is favorable in terms of manufacture, however, to embody the depressions as grooves, since they can then be shaped directly upon extrusion of the plastic elements by way of corresponding nozzle shapes. The grooves can be linear, but can also extend in undulating or meandering fashion.

To make available the largest possible anti-adhesively active area, the depressions can adjoin one another directly with their edges. To achieve good abrasion resistance of the surfaces of the plastic elements, however, it may also be useful to space the depressions apart so that surface regions made of the material of the plastic elements are present between them.

The basic idea of the present invention is suitable for implementation with any plastic elements that constitute the paper side. Particularly suitable for this are flat yarns whose height in the direction transverse to the plane of the paper machine clothing is less than their width, since such flat yarns offer a large area for shaping depressions into the paper side. The flat yarns need not, in this context, have a rectangular cross section, but can also have a trapezoidal or oval or any other outline. The flat yarns can be engaged into a woven or knitted fabric, but can also constitute the coils of wire element belts. The possibility exists instead of assembling the plastic elements from several round individual yarns that are fused to one another (cf. U.S. Pat. No. 5,591,525). Profiled cross-sectional shapes are also suitable, for example those known from DE 40 31 608 A1, U.S. Pat. No. 5,361,808, EP 1 067 239 A2, EP 0 995 835 A1, U.S. Pat. No. 3,158,984, and GB 1 053 282. With such elongated plastic elements, the depressions should extend in their longitudinal direction.

The depressions should have a depth of 10 to 50% of the extension of the plastic elements in the depth direction.

It is understood that the arrangement of depressions with anti-adhesive coating incorporated therein need not be limited to the paper side. Such depressions should be provided wherever deposits of dirt particles occur. This can also be on the side of the plastic elements facing away from the paper side. Depressions with anti-adhesive coating can also be provided on those plastic elements that form the surface on the machine side.

All thermoplastics or similar polymers that are ordinarily used for the manufacture of paper machine clothings are suitable as the material for the plastic elements. Examples of such materials are PET, PPS, PP, PA, PS, PEN, PEK, and/or PEEK, as well as mixtures of these materials. Materials suitable for the anti-adhesive coating are those materials that have also been employed for the anti-adhesive coating already used previously, i.e. silicones, fluorocarbons, or fluoroethylenes.

DESCRIPTION OF THE FIGURES

The invention is elucidated further in the drawings with reference to exemplary embodiments. In the drawings.

DETAILED DESCRIPTION OF THE PREFERRED EMBODIMENT(S)

Figure 1:
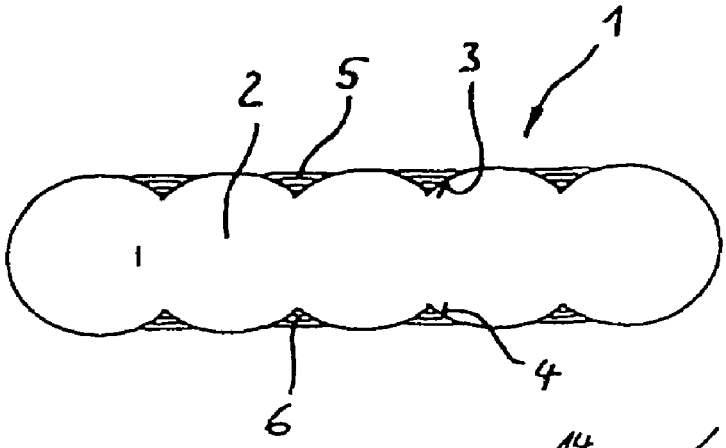
FIG. 1 is a cross-sectional view of a first embodiment of a flat yarn for paper machine clothings in accordance with the invention.

Flat yarn 1 depicted in FIG. 1 is made up of five individual yarns (labeled 2 by way of example), circular in cross section, that are arranged next to one another in one plane and fused to one another. The result of this is to form flat V-shaped depressions (labeled 3 on the upper side and 4 on the lower side by way of example) on the upper and lower side of flat yarn 1. Depressions 3, 4 are all filled, flush with individual yarns 2, with anti-adhesive coating (labeled 5 on the upper side and 6 on the lower side by way of example). Depressions 3, 4 and therefore anti-adhesive coatings 5, 6 extend in the longitudinal direction of flat yarn 1, i.e., like flat yarn 1, perpendicular to the drawing plane. Anti-adhesive coatings 5, 6 prevent the attachment of dirt particles to the upper and lower surfaces of flat yarn 1.

Figure 2:
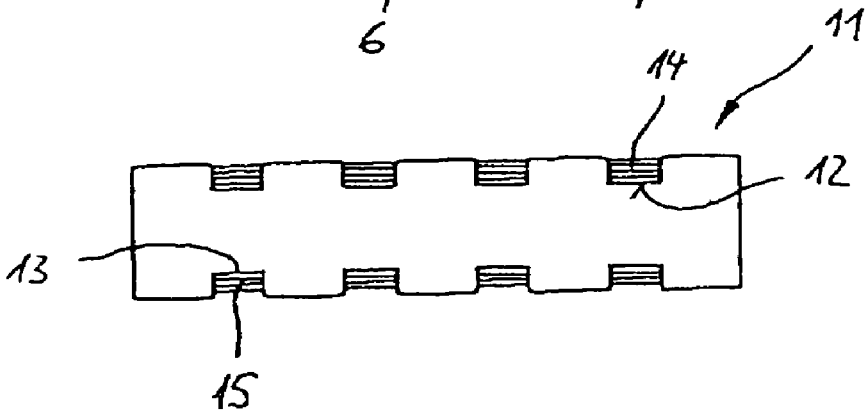
FIG. 2 is a cross-sectional view of a second embodiment of a flat yarn for paper machine clothings in accordance with the invention.

Flat yarn 11 depicted in FIG. 2 has a rectangular cross section. Shaped into the upper and lower side of flat yarn 11 are U-shaped depressions (labeled 12 on the upper side and 13 on the lower side by way of example). Depressions 12, 13 extend in the longitudinal direction of flat yarn 11, i.e. perpendicular to the drawing plane. Anti-adhesive coatings (labeled 14 on the upper side and 15 on the lower side by way of example) are incorporated into depressions 12, 13. Surface segments of flat yarn 11, made of its material, extend between depressions 12, 13. The abrasion resistance of this material allows little abrasion, so that the incorporated anti-adhesive coatings 14, 15 are available during the entire operating life of the paper machine clothing constituted from such flat yarns 11.

Figure 3:
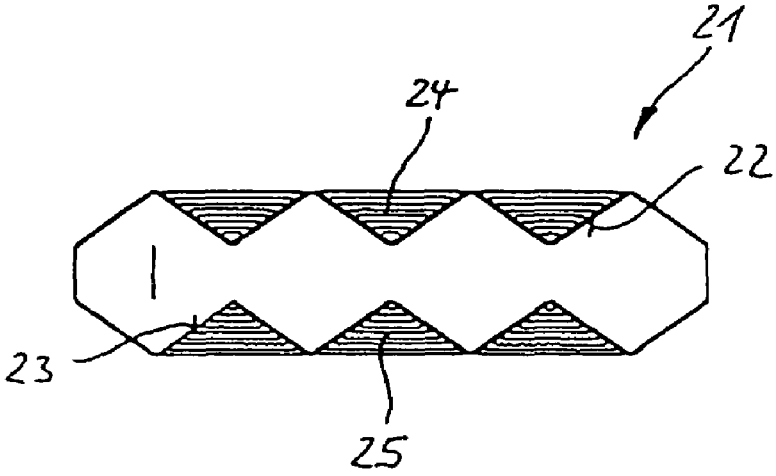
FIG. 3 is a cross-sectional view of a third embodiment of a flat yarn for paper machine clothings in accordance with the invention.

FIG. 3 depicts a flat yarn 21 that is substantially rectangular but tapers conically toward both sides. On the upper and lower side, flat yarn 21 comprises depressions of V-shaped cross section (labeled 22 on the upper side and 23 on the lower side by way of example) that are filled with anti-adhesive coatings (labeled 24 on the upper side and 25 on the lower side). Depressions 22, 23 extend parallel to one another in the longitudinal direction of flat yarn 21, i.e. perpendicular to the drawing plane.

Figure 4:
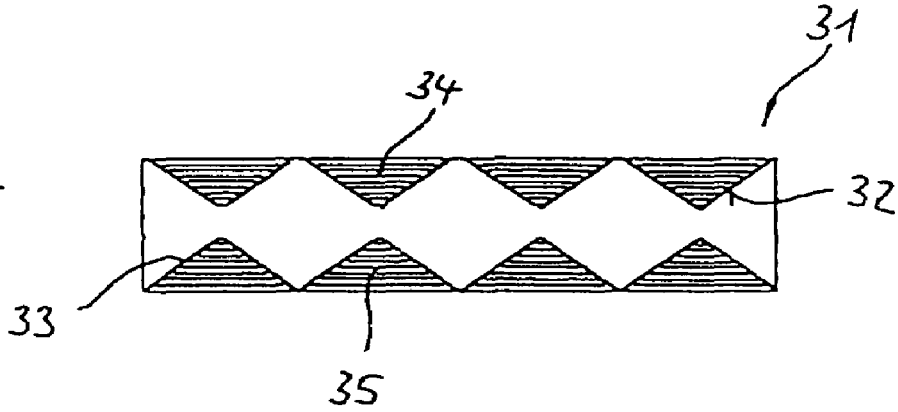
FIG. 4 is a cross-sectional view of a fourth embodiment of a flat yarn for paper machine clothings in accordance with the invention.

Flat yarn 31 depicted in FIG. 4 does not differ substantially from flat yarn 21 shown in FIG. 3. It has a strictly rectangular cross section with V-shaped depressions (labeled 32 on the upper side and 33 on the lower side by way of example) extending in the longitudinal direction, which are filled with anti-adhesive coatings (labeled 34 on the upper side and 35 on the lower side by way of example). As in the example according to FIG. 3, depressions 32, 33 are directly adjacent to one another, so that no surface regions made of the material of flat yarn 31 itself remain. Increasingly widening regions are, however, produced by abrasion.

We claim:

1. The method of forming a paper machine clothing, comprising the steps of:

a) joining a plurality of plastic elements in edge to edge relation, the joined plastic elements creating a plurality of depressions on a surface thereof; and, b) filling the depressions with an anti-adhesive coating.

2. The method of claim 1, wherein the filling of the depressions comprises filling the depressions with the anti-adhesive coating up to the surface of the plastic elements.

3. The method of claim 1, wherein:

the joining of the plastic elements comprises forming a dryer screen having a paper contacting surface; and the filling of the depressions comprises filling the depressions with the anti-adhesive coating such that the paper contacting surface is formed by the anti-adhesive coating and edges that define adjacent depressions.

4. A paper machine clothing, comprising:

a dryer screen formed by a plurality of plastic elements having a first adhesive characteristic, said dryer screen having a paper contact surface with a plurality of depressions formed therein; and an anti-adhesive coating disposed in said depressions in said paper contact surface of said dryer screen, said anti-adhesive coating having a second adhesive characteristic which is less adhesive than said first adhesive characteristic of said plastic elements.

5. The paper machine clothing of claim 4, wherein the depressions are filled flush to a surface of the plastic elements with the anti-adhesive coating.

6. The paper machine clothing of claim 4, wherein the depressions have a trapezoidal or pore-shaped cross section.

7. The paper machine clothing of claim 4, wherein the depressions are embodied in the plastic elements as grooves.

8. The paper machine clothing of claim 4, wherein adjacent edges share a common edge with one another.

9. The paper machine clothing of claim 4, wherein the plastic elements comprise flat yams.

10. The paper machine clothing of claim 9, wherein the flat yams have a rectangular, trapezoidal, or oval outline.

11. The paper machine clothing of claim 4, wherein the plastic elements are assembled from several round individual yams that are fused to one another.

12. The paper machine clothing of claim 4, wherein the depressions extend along the plastic elements.

13. The paper machine clothing of claim 4, wherein the depressions have a depth of 10 to 50% of the extension of the plastic elements in the depth direction.

14. The paper machine clothing of claim 4, wherein the depressions are formed in a paper contacting side of the plastic elements.

15. The paper machine clothing of claim 14, wherein the depressions are formed in a non paper contacting side of the plastic elements that faces away from the paper contacting side.

16. A paper machine clothing, comprising:

a dryer screen formed by a plurality of plastic elements, said dryer screen having a plurality of depressions formed therein and a plurality of edges disposed between the depressions to define the depressions; and an anti-adhesive coating disposed in said depressions of said dryer screen, wherein a surface of the anti-adhesive coating in the depressions forms a paper contact surface along with surfaces of the edges in the dryer screen.

* * * * *